US006772700B2

(12) United States Patent
Wong

(10) Patent No.: US 6,772,700 B2
(45) Date of Patent: Aug. 10, 2004

(54) CONTROL STRUCTURE OF SUPPORTING FOOT FOR COLLAPSIBLE FURNITURE

(76) Inventor: Hsin-Chuan Wong, 7F-2, No. 43, Nung-An Street, Chung-Shang Dist., Taipei (TW)

( * ) Notice: Subject to any disclaimer, the term of this patent is extended or adjusted under 35 U.S.C. 154(b) by 29 days.

(21) Appl. No.: 10/222,652

(22) Filed: Aug. 16, 2002

(65) Prior Publication Data

US 2004/0031422 A1 Feb. 19, 2004

(51) Int. Cl.[7] ..... A47B 3/00
(52) U.S. Cl. ..... 108/133; 108/132
(58) Field of Search ..... 108/133, 132, 108/131, 130; 248/188.6

(56) References Cited

U.S. PATENT DOCUMENTS 3,267,886 A * 8/1966 Glass ..... 108/127
3,554,141 A * 1/1971 Burr ..... 108/132
3,695,567 A * 10/1972 Weagle ..... 248/188.6
5,562,051 A * 10/1996 Rizzi ..... 108/132
5,638,761 A * 6/1997 Berkowitz et al. ..... 108/132
6,112,674 A * 9/2000 Stanford ..... 108/132
6,253,688 B1 * 7/2001 Lor ..... 108/132
6,374,756 B1 * 4/2002 Fieldwick et al. ..... 108/131
6,394,005 B1 * 5/2002 Isensee et al. ..... 108/132
6,422,157 B2 * 7/2002 Rumph ..... 108/132
6,550,405 B2 * 4/2003 Gosselin ..... 108/133

* cited by examiner

*Primary Examiner*—Jose V. Chen

(57) ABSTRACT

A control structure of a supporting foot for collapsible furniture comprises a base having a rotation shaft fixed on the supporting foot. A concave hole is formed in the base and an extension shaft of the rotation shaft is combined with a spring and a sleeve. When the supporting feet are rotated to a predetermined position where the sleeve aims exactly at the concave hole of the base, the sleeve is pushed into the hole by the spring to fix and unfold the supporting feet. On the contrary, when the sleeve is pulled out of the hole, the supporting feet are free now for getting folded and closed together with the furniture body by relative rotation.

3 Claims, 5 Drawing Sheets

CONTROL STRUCTURE OF SUPPORTING FOOT FOR COLLAPSIBLE FURNITURE

FIELD OF THE INVENTION

This invention relates to a control structure of a supporting foot for collapsible furniture, and more particularly, it relates to a rotatable and fixable control structure provided to a supporting foot of collapsible furniture for an easy folding or unfolding of the supporting foot.

BACKGROUND OF THE INVENTION

Collapsible furniture is widely available in the market. The collapsible furniture usually comprises a plurality of supporting feet that can be folded for storage or opened for supporting the furniture. If the supporting feet are not properly kept in an upright position when they are opened, the furniture may collapse. While some collapsible furniture does not have a control structure for supporting the feet of the furniture, some others do have a fixing or control structure. One major drawback of the fixing or control structure is that it has a complex structure which is difficult or inconvenient to use.

SUMMARY OF THE INVENTION

The primary object of this invention is to provide a control structure of a supporting foot for collapsible furniture by combining a rotation shaft to a base fixed on a furniture body in which the supporting foot is soldered to the rotation shaft and a resilient sleeve is provided to the rotation shaft. When the sleeve is pulled to depart from a concave hole in the base, the supporting foot is allowed to rotate freely, or on the contrary, the sleeve will slip into the concave hole automatically to thereby fix the supporting foot when the supporting foot is rotated to turn the sleeve to a corresponding position to the concave hole.

Accordingly, a control structure of a supporting foot for collapsible furniture is formed by disposing a base to the furniture body and a rotation shaft movably to the base. The supporting foot is fixedly arranged on the rotation shaft. A concave hole is formed in the base while a spring and a sleeve are combinedly disposed on an extension shaft of the rotation shaft so that when the supporting foot is rotated to have the sleeve positioned exactly at the concave bole of the base, the sleeve would be pushed into the hole by the spring to hence fix the supporting foot at place. On the contrary, when the sleeve is pulled out of the hole, the supporting foot is released to rotate freely so that the supporting foot might be rotated relatively to the furniture body to be folded and closed.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
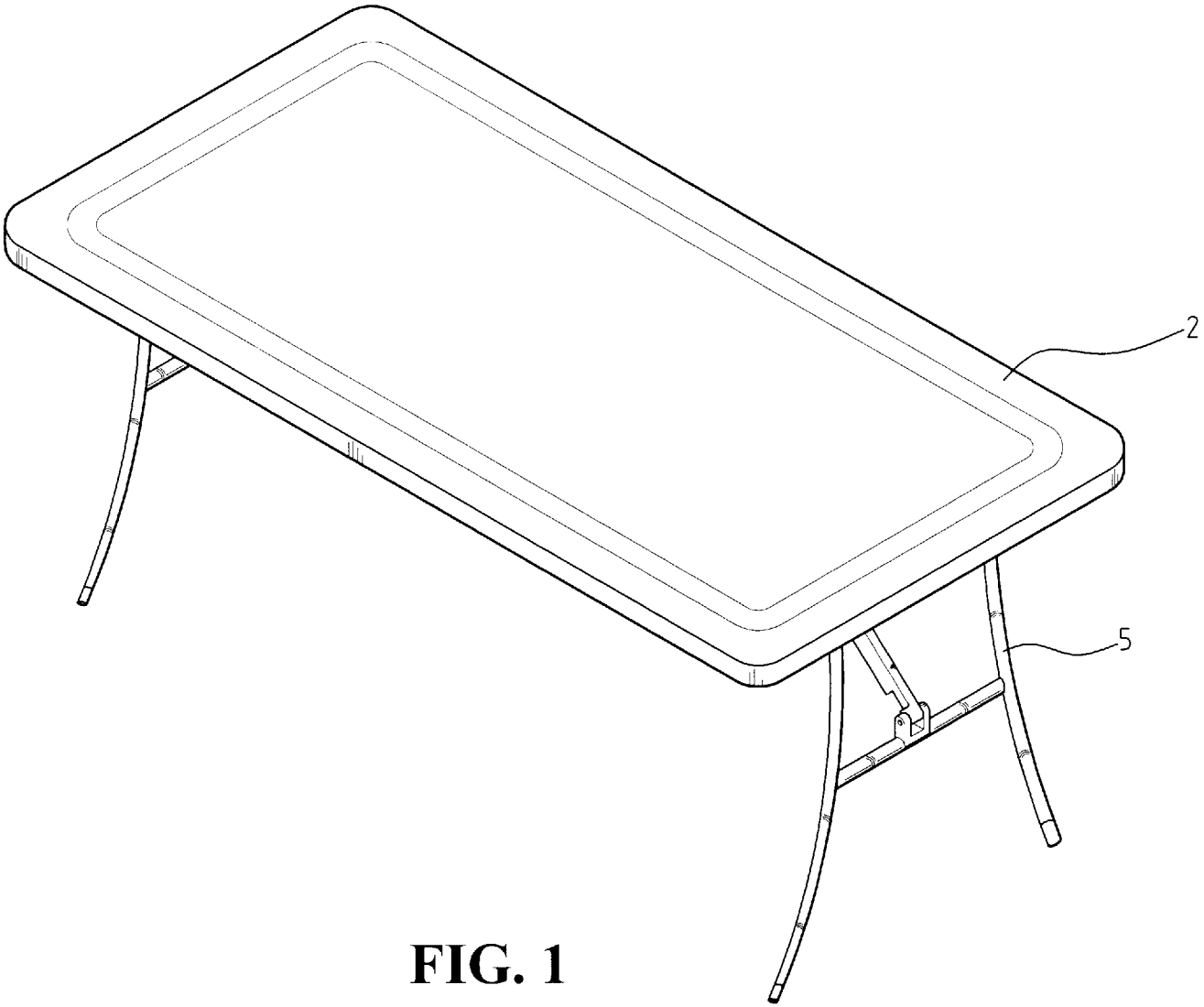
FIG. 1 shows an embodiment of the supporting feet of this invention applied to a table standing normally in three dimensions.

FIG. 1 shows the state that the supporting feet 5 on both sides of collapsible furniture are unfolded to support a furniture body.

Figure 2:
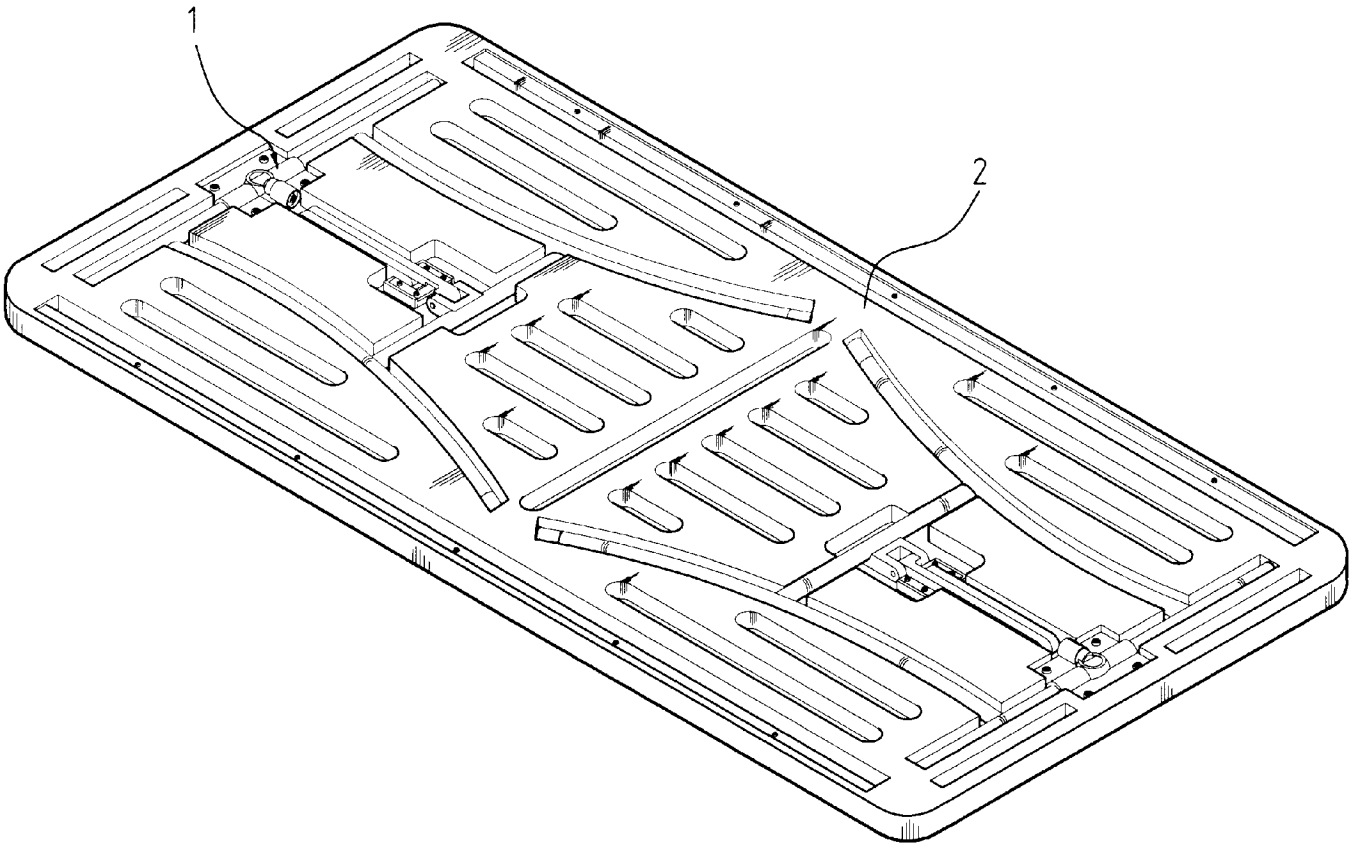
FIG. 2 shows the folded state of the supporting feet of this invention applied to a table lying upside down in three dimensions.

FIG. 2 shows the state that the supporting feet 5 of collapsible furniture are folded and the furniture body is laid inversely.

Figure 3:
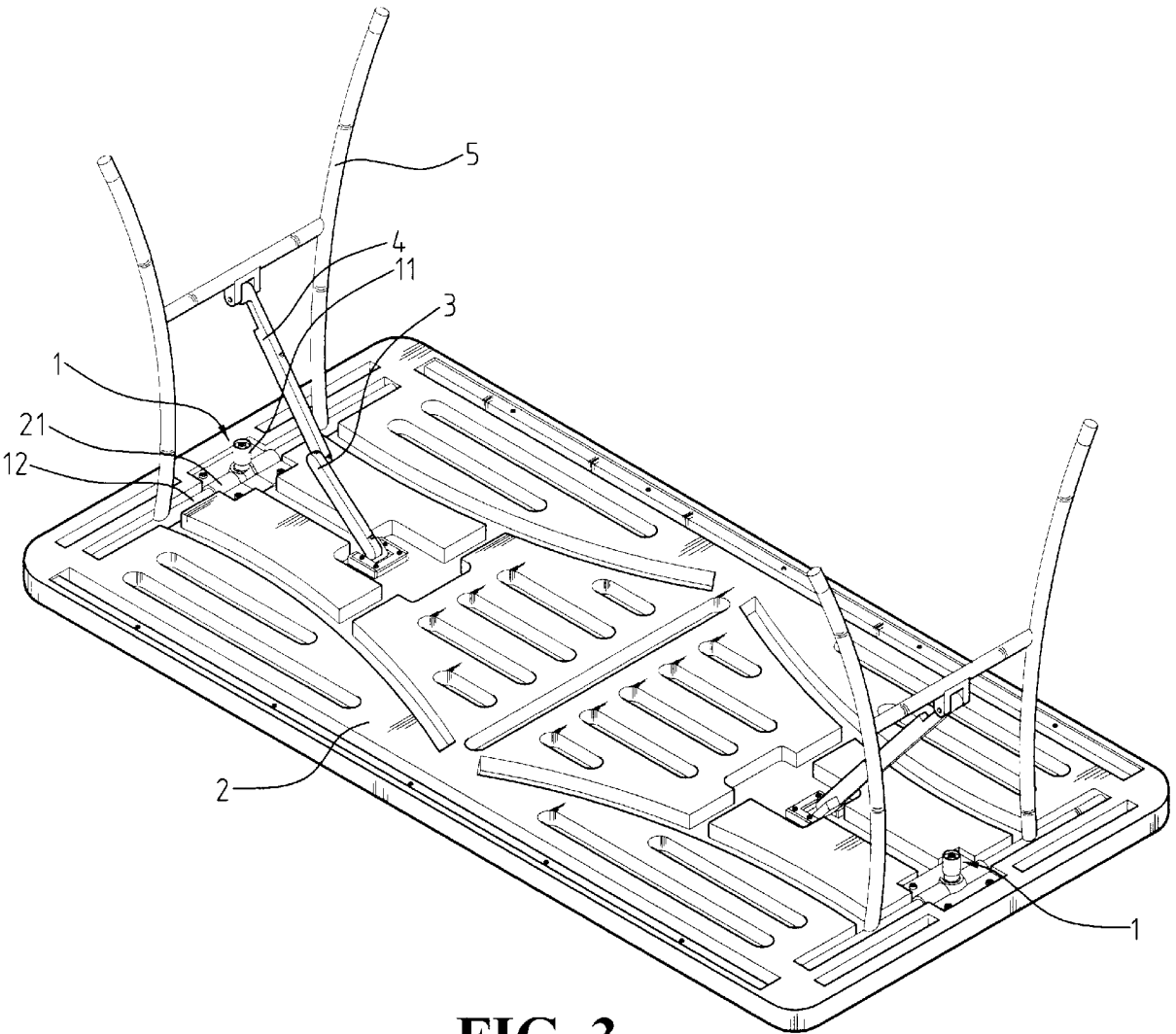
FIG. 3 shows the unfolded state of the supporting feet of this invention applied to a table lying upside down in three dimensions.

FIG. 3 shows the unfolded state of the supporting feet 5 shown in FIG. 2.

Figure 4:
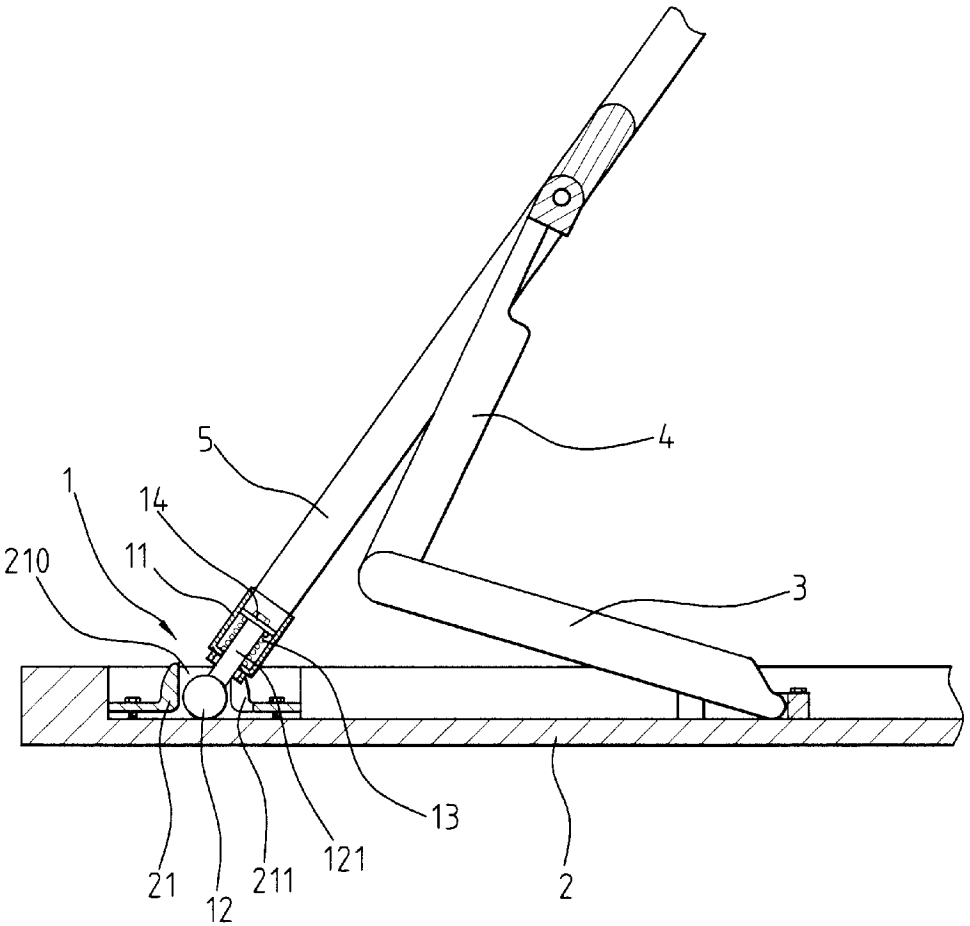
FIG. 4 is a lateral view showing the folded state of a supporting foot controlled by this invention.

As shown in FIGS. 3 and 4, a control structure 1 of this invention comprises a fixedly disposed base 21 on each respective side of the bottom face of a furniture body 2, such as a table. On each base 21, a concave hole 210 having a vertical groove 211 in its lateral wall on one side is formed.

A shaft hole is arranged in the horizontal direction of the base 21, and a rotation shaft 12 is penetratingly disposed in the shaft hole so that the rotation shaft 12 can be rotated relatively to the base 21. The rotation shaft 12 is provided with an extension shaft 121 perpendicular to the shaft 12. The extension shaft 121 can be rotated within an angular range at both ends of the groove 211 when the rotation shaft 12 is rotated relatively to the base 21.

The rotation shaft 12 is soldered to joint with the supporting feet 5 of the furniture body 2. In an embodiment of this invention, the supporting feet 5 are H-shaped so that a transverse beam thereof can be pivotally jointed to a second link 4 that is in turn axially jointed to a first link 3 that is finally axially jointed to the furniture body 2. When the supporting feet 5 are unfolded, both the first and the second links 3/4 would serve as reinforcement rods to support the supporting feet 5 (as indicated in FIG. 3). On the contrary, those first and second links 3/4 are supposed to rotate to approach each other and contact the furniture body 2 when the supporting feet 5 are folded to the furniture body 2 (as indicated in FIG. 2).

This invention provides a sleeve 11 to the extension shaft 121, which is combined to the rotation shaft 12. The sleeve 11 has an outer diameter smaller than the diameter of the concave hole 210 and has an inner space with a bottom portion provided with a hole for the extension shall 121 to penetrate, in which the inner diameter at the top end of the inner space is larger than the diameter of the extension shaft 121. After the extension shaft 121 has penetrated through both the hole at the bottom portion and the inner space of the sleeve 11, it then wears a spring 13 in its inner space in the manner that one end of the spring 13 would contact the bottom end of the inner space of the sleeve 11. Then, a washer 14 is provided and locked to the end of the extension shaft 121 to prevent the spring from slipping off. A restoring force of the spring 13 applied on the sleeve 11 pulls the latter towards the rotation shaft 12.

Referring to FIG. 4, when the sleeve 11 is pulled to depart from the concave hole 210, the supporting feet 5 will be rotated around the rotation shaft 12 and go further to the furniture body 2 to get even folded since there is no bondage made to the rotation shaft 12. During the rotating process of the rotation shaft 12, the extension shaft 121 is supposed to be rotated in the groove 211, and the lower end of the sleeve 11 always keeps in touch with the outer surface of the base 21 and moves along that surface due to the pressure of the spring 13.

Figure 5:
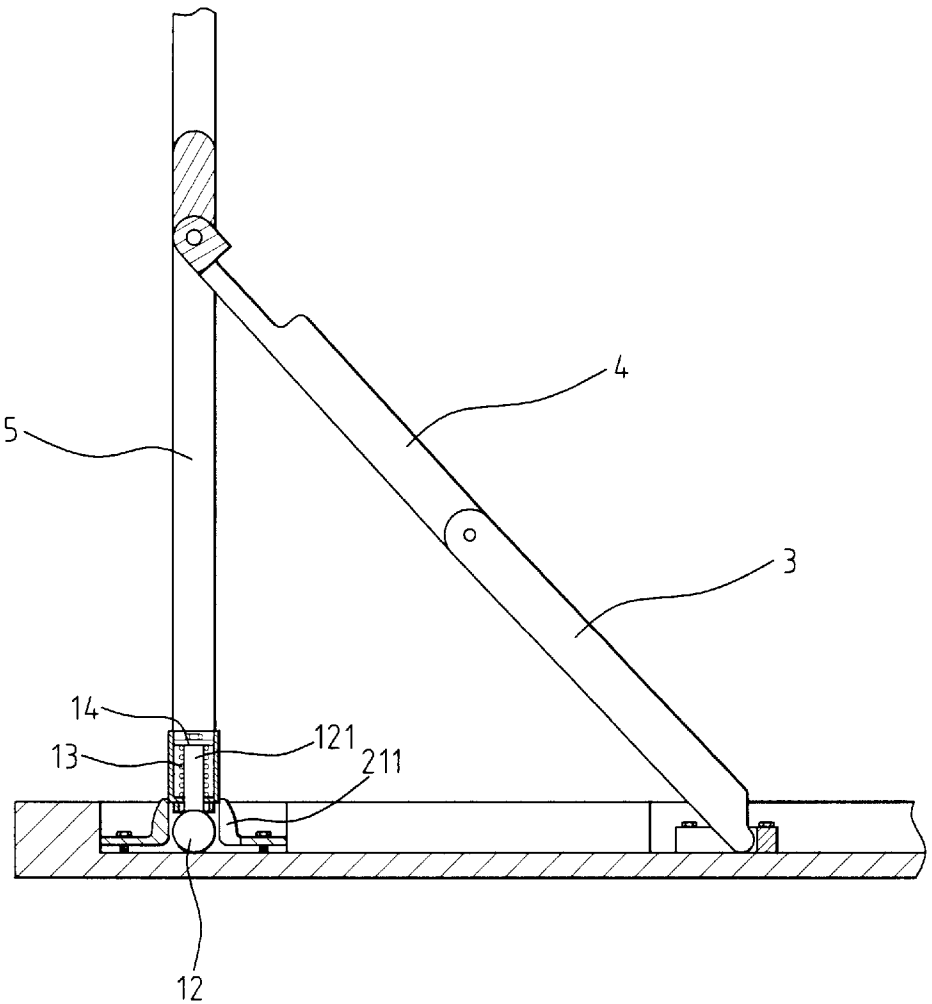
FIG. 5 is a lateral view showing the unfolded state of the supporting foot controlled by this invention.

When the rotation shaft 12 is centered for the supporting foot 5 to rotate about for unfolding itself until a predetermined angle is achieved so that the sleeve 11 is aiming at the concave hole 210 of the furniture body 2 exactly, the sleeve 11 is pushed by the spring 13 then and there to be inserted in the concave hole 210 to have the supporting foot fixed in the base 21 (as shown in FIG. 5). In the mean time, both the first and the second links 3/4 are thoroughly straightened for reinforcement of the supporting foot 5. As can be seen from FIGS. 2 and 3, the rotation shaft 12 is disposed in shaft hole below the base 21 which is mounted to the bottom of the table. The supporting feet 5 are soldered to the rotation shaft 12. The extension shaft 121 which is extended from the rotation shaft 12 can be rotated from the bottom of the table along the groove 211 to a vertical position at which the sleeve 11 can be received in the concave hole 210 and the supporting feet 5 are fixed in an opened state. When the sleeve 11 is pulled out from the concave hole 210, the supporting feet 5 can be pushed towards the bottom of the table, folding the first and second links 3, 4.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. A control structure of a supporting foot for collapsible furniture, comprising:

a base mounted on a furniture body, said base forming a shaft hole and having a concave hole and a groove on a side of said concave hole;

a rotation shaft disposed in said shaft hole, said rotation shaft being jointed with at least one supporting foot;

an extension shaft extended perpendicularly from said rotation shaft near said concave hole and said groove, said extension shaft being rotatable along a channel formed by said groove and said concave hole;

a sleeve, collaring said extension shaft, said sleeve having one end receivable in said concave hole but not receivable in said groove;

a spring collaring said extension shaft between said extension shaft and said sleeve, said spring pushing said sleeve towards said base and preventing said sleeve from slipping off said extension shaft;

wherein said extension shaft is substantially in parallel with said at least one supporting foot which is opened to support said furniture body when said extension shaft is rotated to a position where said sleeve is received in said concave hole.

2. The control structure of a supporting foot for collapsible furniture as claimed in claim 1, said rotation shaft being jointed with two supporting feet connected by a beam member, wherein said beam member is pivotally connected to a first link which is pivotally connected to a second link pivotally mounted on said furniture body.

3. The control structure of a supporting foot for collapsible furniture as claimed in claim 1, wherein a washer is mounted on one end of said extension shaft to keep said spring between said sleeve and said extension shaft.

* * * * *